US009211633B2

(12) United States Patent
Liu et al.

(10) Patent No.: US 9,211,633 B2
(45) Date of Patent: Dec. 15, 2015

(54) METAL-BONDED DIAMOND GRINDING WHEEL PREPARED BY SELF-PROPAGATING PRESSURE-LESS SINTERING AND A PREPARATION METHOD THEREOF

(75) Inventors: Mingyao Liu, Zhengzhou (CN); Junyong Shao, Zhengzhou (CN); Juxue Xia, Zhengzhou (CN)

(73) Assignees: Zhengzhou Research Institute for Abrasives & Grinding Co., Ltd., Zhengzhou (CN); Zhengzhou Shine More Superabrasives Co., Ltd., Zhengzhou (CN)

( * ) Notice: Subject to any disclaimer, the term of this patent is extended or adjusted under 35 U.S.C. 154(b) by 260 days.

(21) Appl. No.: 13/504,459

(22) PCT Filed: Mar. 28, 2011

(86) PCT No.: PCT/CN2011/000524
§ 371 (c)(1),
(2), (4) Date: Jul. 3, 2012

(87) PCT Pub. No.: WO2012/024884
PCT Pub. Date: Mar. 1, 2012

(65) Prior Publication Data

US 2013/0143476 A1 Jun. 6, 2013

(30) Foreign Application Priority Data

Aug. 26, 2010 (CN) ..... 2010 1 0263648

(51) Int. Cl.
*B24D 18/00* (2006.01)
*B24D 3/06* (2006.01)
*B24D 5/00* (2006.01)

(52) U.S. Cl.
CPC *B24D 18/00* (2013.01); *B24D 3/06* (2013.01); *B24D 5/00* (2013.01)

(58) Field of Classification Search
CPC ..... B24D 18/00; B24D 5/00; B23D 3/06
USPC ..... 451/548; 51/307–309
See application file for complete search history.

(56) References Cited

U.S. PATENT DOCUMENTS

| | | | | |
|---|---|---|---|---|
| 4,985,051 | A * | 1/1991 | Ringwood | 51/309 |
| 5,123,935 | A * | 6/1992 | Kanamaru et al. | 51/309 |
| 6,395,045 | B1 * | 5/2002 | Bucar et al. | 51/307 |
| 6,432,150 | B1 * | 8/2002 | Levashov et al. | 51/293 |
| 6,485,532 | B2 * | 11/2002 | Andrews et al. | 51/297 |
| 6,629,884 | B1 * | 10/2003 | Goers | 451/540 |
| 2004/0235406 | A1 * | 11/2004 | Duescher | 451/527 |
| 2007/0275636 | A1 * | 11/2007 | Rutkiewicz et al. | 451/7 |
| 2009/0017736 | A1 * | 1/2009 | Block et al. | 451/260 |
| 2009/0084042 | A1 * | 4/2009 | Ramanath et al. | 51/296 |
| 2009/0165768 | A1 * | 7/2009 | Kasashima et al. | 125/15 |
| 2010/0159806 | A1 * | 6/2010 | Wu et al. | 451/28 |

FOREIGN PATENT DOCUMENTS

| | | | |
|---|---|---|---|
| CN | 101342686 | A | 1/2009 |
| CN | 101934501 | A | 1/2011 |
| EP | 1013379 | A1 | 6/2000 |
| RU | 2184644 | C2 | 7/2002 |

* cited by examiner

*Primary Examiner* — Lee D Wilson
*Assistant Examiner* — Henry Hong
(74) *Attorney, Agent, or Firm* — Drinker Biddle & Reath LLP

(57) ABSTRACT

The invention discloses a metal-bonded diamond grinding wheel prepared by self-propagating pressure-less sintering and a preparation method thereof. The metal bonded diamond grinding wheel mainly comprises a working layer and a non-working layer, wherein the working layer comprises metal bond and grinded diamond, the non-working layer is metal bond, and the metal bond in the working layer and non-working layer have the same components that comprise metal powders of Cu, Al, Ni, Ti, Sn, and Co. To prepare the metal-bonded diamond grinding wheel prepared by self-propagating pressure-less sintering solves the problems of high energy consumption and low manufacture efficiency in the current sintering processes of the metal bonded diamond grinding wheel, and improves the binding force of the metal bond to the grinded diamond by forming carbides between the bond and the grinded diamond.

19 Claims, No Drawings

METAL-BONDED DIAMOND GRINDING WHEEL PREPARED BY SELF-PROPAGATING PRESSURE-LESS SINTERING AND A PREPARATION METHOD THEREOF

CLAIM FOR PRIORITY

This application is a national stage application (under 35 U.S.C. §371) of PCT/CN2011/000524, filed Mar. 28, 2011, which claims priority to Chinese Application No. CN 201010263648.X, filed Aug. 26, 2010.

FIELD OF THE INVENTION

The present application relates to a metal-bonded diamond grinding wheel and a preparation method thereof, and particularly to a metal-bonded diamond grinding wheel and a self-propagating pressure-less sintering preparation method thereof.

BACKGROUND OF THE INVENTION

Diamond grinding wheels are usually manufactured by metal bond, vitrified bond or resin bond, wherein the metal-bonded grinding wheel has good profile maintaining capability, ideal service life and higher grinding efficiency, and thereby is applied broadly in production fields of nonferrous metallic materials and non-metallic materials, and etc., such as stone, ceramic, refractory materials, hard alloys, magnetic materials and semiconductor materials, and etc.

The metal bonded diamond grinding wheel is usually manufactured by powder metallurgy, and the manufacturing process thereof mainly comprises materials mixing, compression molding, sintering, post-processing and the like. The preparation process directly affects the working performance of the metal-bonded diamond grinding wheel. Currently there have been three major preparation methods for metal-bonded grinding wheel stocks, i.e. cold compression molding-sintering, hot compression molding-sintering, and semi-hot compression molding-sintering.

In the cold compression molding-sintering process, molded materials are applied a certain pressure in a steel mould so as to be pressed into stocks. After the mould is removed, the stocks are sintered in a furnace without pressure. The main disadvantages of this method lie in the high pressure required for molding, long time for sintering, large energy consumption, and poor mechanical and utility performances of the product. Specifically, it will take a large amount of energy to sinter the stocks in the pressure-less sintering process to achieve the desire purpose. The temperature for sintering maintains for from one to two hours, and the production cycle is too long. Therefore, at present this process is seldom applied.

In general, for the hot compression molding-sintering method, there are two approaches, i.e. medium frequency induction heating and high-current resistance heating. In the hot compression molding-sintering process, the molded materials are often heated and compressed simultaneously in a graphite mould (i.e. to be hot compressed-sintered directly). Alternatively, the molded materials may be cold compressed in a steel mould into stocks having a certain density and strength, and then hot compressed-sintered in the graphite mould. The hot compression molding-sintering method has the following disadvantages: firstly, the size of the prepared grinding tools is limited by the graphite mould, and usually has a diameter of no more than 300 mm; secondly, large amounts of energy are consumed during the medium frequency induction heating and high-current resistance heating processes; thirdly, the quantity of products per each sintering process is limited, and the production efficiency is low.

In the semi-hot compression molding-sintering method, molded materials are pre-pressed in a steel mould into stocks having a certain density and strength, then the stocks, are sintered together with the mould or an altered outer mould without pressure. After the sintering is finished, the stocks are moved out of the furnace and compressed to a desired density. Generally, this method is applicable to grinding tools having relatively large sizes, and its major disadvantages lie in that the temperature for heating is required to maintain for about 30 minutes, and the quantities of products sintered is about one to ten each time, which results in its large energy consumption and low production efficiency.

A bond system employed by the aforementioned methods for producing the metal-bonded diamond grinding wheel mainly comprises Cu—Sn system, such as the one applied in the Japanese Patent Application JP58-217271; Ni—Cu—Sn system, such as the one applied in the Chinese Patent Application CN200410031285.1; and Al—Cu system, such as the one applied in the Chinese Patent Application CN200610037510.1. The sintering methods with these bond systems are direct hot compression molding-sintering or semi-hot compression molding-sintering, both of which are to achieve the sintering process by providing the external heat. To prevent the diamond from graphitization, the sintering temperature is usually controlled no higher than 900□. These bond systems can neither initiate exothermic reaction during the sintering process, nor form carbides between the bond and the grinded diamond, thereby can not achieve the firm bonding. Strong carbide formers added to the metal bond may form a carbide layer with the surface of diamond, which will improve the binding force of the bond on the diamond. However, typically a high temperature of 1200° C. will be required to form the carbide layer. Therefore, under conventional sintering conditions, it is very difficult for the strong carbide formers and the surface of diamond to form a continuous and uniform carbide layer.

SUMMARY OF THE INVENTION

The present invention provides a metal-bonded diamond grinding wheel prepared by self-propagating pressure-less sintering and a preparation method thereof, with the aim to solve the current problems of large energy consumption and low production efficiency in the metallic-bonded diamond grinding wheel sintering process, and to improve the binding force of the metal bond on the grinded diamond by forming carbides between the bond and grinded diamond.

The objective of the invention is achieved by the following technical solution:

In one aspect, the invention provides a metal-bonded diamond grinding wheel prepared by self-propagating pressure-less sintering, which mainly comprises a working layer and a non-working layer, wherein the working layer comprises metal bond and grinded diamond, the non-working layer is metal bond, and the metal bond of the working layer and non-working layer have the same components. Said metal bond satisfy the requirements for self-propagating sintering, and comprise metal powders of Cu, Al, Ti, Ni, and Sn, preferably, said metal bond further comprise Co powder.

Preferably, the parts by weight ratio of each said metallic powders in said metallic bond is Cu:Al:Ti:Ni:Sn:Co=50~80:3~20:5~20:5~20:4~10:0~5.

More preferably, the parts by weight ratio of each said metallic powders is Cu:Al:Ti:Ni:Sn:Co=63~70:5~10:10~15:5~12:6~10:3~5.

Most preferably, the parts by weight ratio of each said metallic powders is Cu:Al:Ti:Ni:Sn:Co=63:7:5:15:10:3.

Preferably, said grinded diamond of said grinding wheel have a grain size of 70/80~600/700, and a concentration of 20%~100%.

More preferably, said grinded diamond of said grinding wheel have a grain size of 80/100~325/400, and a concentration of 75%~100%.

Most preferably, said grinded diamond of said grinding wheel have a grain size of 80/100, and a concentration of 100%.

Preferably, said metallic powders of said grinding wheel have an average grain size of no larger than 38 microns.

In another aspect, the present invention provides a method for preparing said grinding wheel. The method comprises the following steps:

mixing raw materials;

compression molding the resultant; and sintering the resultant;

wherein said sintering is self-propagating pressure-less sintering.

Preferably, said self-propagating pressure-less sintering step of said method comprises, after the steps of mixing and compression molding, placing the metal-bonded diamond grinding wheel stock in a furnace with a temperature of 500° C. to 650° C., initiating a self-propagating reaction, then cutting off the power supply, sintering and densifying said stock by its own exothermic reaction without applying any external loads, finally cooling it along with the furnace to a room temperature to obtain a metal-bonded diamond grinding wheel.

The components of said metal bond of said method comprise the following parts by weight of metallic powders: Cu 50~80 parts, Al 3~20 parts, Ti 5~20 parts, Ni 5~20 parts, Sn 4~10 parts and Co 0~5 parts; preferably comprises the following metallic powders by weight part: Cu 63~70 parts, Al 5~10 parts, Ti 10~15 parts, Ni 5~12 parts, Sn 6~10 parts and Co 3~5 parts; and more preferably comprises the following parts by weight of metallic powders: Cu 63 parts, Al 7 parts, Ni 5 parts, Ti 15 parts, Sn 10 parts and Co 3 parts.

According to a preferred embodiment of the present invention, the metal-bonded diamond grinding wheel prepared by self-propagating pressure-less sintering mainly comprises a working layer and a non-working layer, wherein the working layer comprises metal bond and grinded diamond, and the non-working layer is metal bond. The metal bond of the working layer and non-working layer have the same components that comprise the following parts by weight of the metallic powders:Cu 50~80 parts, Al 3~20 parts, Ti 5~20 parts, Ni 5~20 parts, Sn 4~10 parts and Co 0~5 parts; preferably comprises the following parts by weight of metallic powders: Cu 63~70 parts, Al 5~10 parts, Ti 10~15 parts, Ni 5~12 parts, Sn 6~10 parts and Co 3~5 parts; and more preferably comprises the following parts by weight of metallic powders:Cu 63 parts, Al 7 parts, Ni 5 parts, Ti 15 parts, Sn 10 parts and Co 3 parts.

Furthermore, said grinded diamond have a grain size of 70/80~600/700, and a concentration of 20%~100%; preferably have a grain size of 80/100~325/400, and a concentration of 75%~100%, more preferably have a grain size of 80/100, and a concentration of 100%.

Said grain size can be represented by the numbers of screen meshes in a length of 2.54 cm (i.e. 1 inch), subject to the mesh sizes of two adjacent screens wherein one can be passed by the grinded diamond while the other cannot, which is abbreviated as "mesh", see the Chinese national standard GB/T6406-1996. Said concentration is the density of the diamond distributed in the sintered working layer matrix. And according to the provision of Chinese national standard GB/T6409.1-94, the concentration is 100% where 4.4 carats of diamond is contained in 1 $cm^3$ working layer matrix; and the concentration is 75% where 3.3 carats of diamond is contained.

Furthermore, said metallic powders have an average grain size of no more than 38 microns.

In another aspect, the present invention further provides a method for preparing said grinding wheel, which comprises steps of mixing materials, compression molding and sintering, wherein said sintering is self-propagating pressure-less sintering, and said mixing is conducted in a mixer of any forms already known in the prior art of the abrasives field.

Furthermore, said self-propagating pressure-less sintering step comprises: after the steps of mixing and compression molding, placing a metal-bonded diamond grinding wheel stock in a furnace with a temperature of 500° C. to 650° C., heating the stock quickly so as to initiate the reactions between Al and Ti and between Al and Ni in the working and non-working layers of the grinding wheel; once the temperature of stock being 50° C. higher than that of the furnace according to an infrared temperature measurement system, which marks the start of reaction, then cutting off the power supply, sintering and densifying it by its own exothermic reaction without applying any external loads, so as to achieve the sintering (i.e. self-propagating reaction); finally cooling it along with the furnace to a room temperature to obtain a metal-bonded diamond grinding wheel.

Furthermore, the components of said metal bond comprise the following parts by weight of metallic powders: Cu 50~80 parts, Al 3~20 parts, Ti 5~20 parts, Ni 5~20 parts, Sn 4~10 parts and Co 0~5 parts; preferably comprise the following parts by weight of metallic powders:Cu 63~70 parts, Al 5~10 parts, Ti 10~15 parts, Ni 5~12 parts, Sn 6~10 parts and Co 3~5 parts; and more preferably comprise the following part by weight of metallic powders:Cu 63 parts, Al 7 parts, Ni 5 parts, Ti 15 parts, Sn 10 parts and Co 3 parts.

The sintering method employed by the present invention is self-propagating pressure-less sintering, and the main principles thereof lie in initiating exothermic chemical reaction by igniting active components in the bond, then maintaining the reaction by the released heat, and at the same time directly completing the sintering of the product having a desired shape and size by controlling the conditions like exothermic reaction temperature, reaction speed and so on. The process thereof is as follows: directly igniting the powders or stocks, then cutting off the power supply, sintering and densifying it by its own exothermic reaction without applying any external loads. The self-propagating pressure-less sintering mainly has the following advantages: the devices required for the sintering process is simple and cost-effective; the reaction takes a short time and finishes quickly, which leads to a relatively higher sintering efficiency; the whole sintering process can be accomplished merely by ignition, which takes advantage of the heat released by itself and does not require any energy from outside, in other words, the energy consumption of the sintering process is relatively lower; high heat is released at the moment of self-propagating pressure-less sintering, which is in favor of forming new products and improving the purity of the products.

The present invention mainly utilizes a high temperature furnace to initiate the reaction of raw materials, and takes advantages of the heat released by the reaction to achieve the sintering process. The bond consist of Cu, Al, Ti, Ni, Sn, and Co. Said exothermic reaction mainly refers to the reaction of Al with Ti and Ni, and the heat released by them are used to maintain the sintering process. Moreover, adding Ti to a Cu-based metallic binder may reduce the contact angle between the matrix and diamond, and improves the adhesive strength of the matrix and diamond; because of the high temperature occurred instantaneously in self-propagating pressure-less sintering, strong carbide former Ti can form carbide on the surface of diamond by means of chemical reaction, so as to enhance the binding force to the grinded diamond, improve the grinding performance of diamond grinding wheel and prolong the product's service life; Ni may react with Al so as to provide more energy for the whole sintering process; Ni has effect of dispersion-strengthen to the bond so as to improve the bond' strength and binding force to the grinded diamond; adding Ni to a Cu—Ti alloy may further improve the mechanical performance of the materials; the addition of low melting point metal Sn can improve the performance of Cu-based binder and the binder's binding force to the grinded diamond, so as to meet the requirements of grinding processes; and the addition of Co aims to improve the strength of the binder so as to meet the requirements of grinding processes of various work pieces.

The metallic powder system of non-working layer is identical to that of working layer. This results in that the heat released from the reaction in working and non-working layers of the grinding tool during the sintering process are identical, so as to avoid incomplete sintering which may be caused by the condition where the working layer releases heat while the non-working layer does not release heat but absorbs the heat released by the working layer, and results in that the contraction and expansion rates of the working and non-working layers are identical with each other, so as to prevent the shape of grinding tool from being changed.

In conclusion, the beneficial effects of the metal-bonded diamond grinding wheel prepared by self-propagating pressure-less sintering and the preparation method thereof provided by the present invention are as follows:

Compared with the sintering process in the prior art, the self-propagating sintering has advantages of lower energy consumption and higher production efficiency, which can reduce investment and production costs; besides, the metallic elements in the bond significantly improve the binding force of the bond to the grinded diamond as well as the mechanical performance of the grinding wheel, so as to increase the grinding efficiency of grinding wheel and prolong the product's service life.

DETAILED DESCRIPTION OF PREFERRED EMBODIMENTS

The present invention will be further described, but not limited by the following examples. Without particularly stated, the reagents, materials, methods and devices are all commercial products or conventional ones in this technical field.

EXAMPLE 1

The steps for preparing a metal-bonded diamond grinding wheel by self-propagating pressure-less sintering include:

1) Mixing raw materials:

Each metallic powders of bond weighed based on the mass ratio as Cu 63 parts, Al 7 parts, Ni 5 parts, Ti 15 parts, and Sn 10 parts as well as a liquid paraffin humectant are charged into in a three-dimensional mixer to mix homogeneously for 40 minutes in order to obtain metal bond; 21.68 grams of said bond used as the bond in working layer are mixed with 19 carats of grinded diamond having a grain size of 70/80 to mix sufficiently and homogeneously in the mixer for 30 minutes so as to obtain working layer materials; while 63.12 grams of said binder are used as non-working layer binder so as to obtain non-working layer materials.

2) Compression molding:

The working and non-working layer materials obtained by step 1) are homogeneously charged into a reserved cavity of a mould, respectively. The materials are shaved smoothly and arranged into a compressing machine to be compression molded, so as to obtain a stock of diamond grinding wheel.

3) Sintering:

The compressed stock is quickly charged into a muffle furnace heated to 550° C. The self-propagating reaction of the stock is initiated, and the stock is sintered freely in the air. Then the power supply is cut off, and the stock is sintered and densified by its own exothermic reaction without applying any external loads. Finally, the stock is cooled along with the furnace to a room temperature to obtain a metal-bonded diamond grinding wheel.

The obtained metal-bonded diamond grinding wheel has a dimension as follows:

Φ60 mm×5 mm(thickness of the wheel)×10 mm(inner pore)×5 mm(annular width of the working layer)

Concentration of the diamond: 100%.

EXAMPLE 2

The steps for preparing a metal bonded diamond grinding wheel by self-propagating pressure-less sintering include:

1) Mixing raw materials:

Each metallic powders of bond weighed based on the mass ratio as Cu 69 parts, Al 5 parts, Ni 10 parts, Ti 5 parts, Sn 8 parts and Co 3 parts as well as a liquid paraffin humectant are charged into in a three-dimensional mixer to mix homogeneously for 40 minutes in order to obtain metal bond; 45.65 grams of said bond used as the bond in working layer are mixed with 24.6 carats of grinded diamond having a grain size of 140/170 to mix sufficiently and homogeneously in the mixer for 30 minutes so as to obtain working layer materials; while 236.58 grams of said bond are used as non-working layer bond so as to obtain non-working layer materials.

2) Compression molding:

The working and non-working layer materials obtained by step 1) are homogeneously charged into a reserved cavity of a mould, respectively. The materials are shaved smoothly and arranged into a compressing machine to be compression molded, so as to obtain a stock of diamond grinding wheel.

3) Sintering:

The compressed stock is quickly charged into a muffle furnace heated to 500° C. The self-propagating reaction of the stock is initiated, and the stock is sintered freely in the air. Then the power supply is cut off, and the stock is sintered and densified by its own exothermic reaction without applying any external loads. Finally, the stock is cooled with the furnace to a room temperature to obtain a metal-bonded diamond grinding wheel.

The obtained metal bonded diamond grinding wheel has a dimension as follows:

Φ100 mm×5 mm(thickness of the wheel)×10 mm(inner pore)×5 mm(annular width of the working layer)

Concentration of the diamond: 75%.

EXAMPLE 3

The steps for preparing a metal bonded diamond grinding wheel by self-propagating pressure-less sintering include:

1) Mixing raw materials:

Each metallic powders of bond weighed based on the mass ratio as Cu 66 parts, Al 10 parts, Ni 6 parts, Ti 12 parts, and Sn 6 parts as well as a liquid paraffin humectant are charged into in a three-dimensional mixer to mix homogeneously for 40 minutes in order to obtain metal bond; 13.77 grams of said bond used as the bond in working layer are mixed with 8.55 carats of grinded diamond having a grain size of 80/100 to mix sufficiently and homogeneously in the mixer for 30 minutes so as to obtain working layer materials; while 36.98 grams of said bond are used as non-working layer bond so as to obtain non-working layer materials.

2) Compression molding:

The working and non-working layer materials obtained by step 1) are homogeneously charged into a reserved cavity of a mould, respectively. The materials are shaved smoothly and arranged into a compressing machine to be compression molded, so as to obtain a stock of diamond grinding wheel.

3) Sintering:

The compressed stock is quickly charged into a muffle furnace heated to 600° C. The self-propagating reaction of the stock is initiated, and the stock is sintered freely in the air. Then the power supply is cut off, and the stock is sintered and densified by its own exothermic reaction without applying any external loads. Finally, the stock is cooled along with the furnace to a room temperature to obtain a metal-bonded diamond grinding wheel.

The obtained metal bonded diamond grinding wheel has a dimension as follows:

Φ60 mm×3 mm(thickness of the wheel)×10 mm(inner pore)×5 mm(annular width of the working layer)

Concentration of the diamond: 75%.

EXAMPLE 4

The steps for preparing a metal bonded diamond grinding wheel by self-propagating pressure-less sintering include:

1) Mixing raw materials:

Each metallic powders of bond weighed based on the mass ratio as Cu 67 parts, Al 7 parts, Ni 10 parts, Ti 10 parts, and Sn 6 parts as well as a liquid paraffin humectant are charged into in a three-dimensional mixer to mix homogeneously for 40 minutes in order to obtain metal bond; 5.49 grams of said bond used as the bond in working layer are mixed with 4.6 carats of grinded diamond having a grain size of 325/400 to mix sufficiently and homogeneously in the mixer for 30 minutes so as to obtain working layer materials; while 13.19 grams of said bond are used as non-working layer bond so as to obtain non-working layer materials.

2) Compression molding:

The working and non-working layer materials obtained by step 1) are homogeneously charged into a reserved cavity of a mould, respectively. The materials are shaved smoothly and arranged into a compressing machine to be compression molded, so as to obtain a stock of diamond grinding wheel.

3) Sintering:

The compressed stock is quickly charged into a muffle furnace heated to 650° C. The self-propagating reaction of the stock is initiated, and the stock is sintered freely in the air. Then the power supply is cut off, and the stock is sintered and densified by its own exothermic reaction without applying any external loads. Finally, the stock is cooled along with the furnace to a room temperature to obtain a metal-bonded diamond grinding wheel.

The obtained metal bonded diamond grinding wheel has a dimension as follows:

Φ40 mm×3 mm(thickness of the wheel)×10 mm(inner pore)×5 mm(annular width of the working layer)

Concentration of the diamond: 100%.

EXAMPLE 5

The steps for preparing a metal bonded diamond grinding wheel by self-propagating pressure-less sintering include:

1) Mixing raw materials:

Each metallic powders of bond weighed based on the mass ratio as Cu 51 parts, Al 15 parts, Ni 18 parts, Ti 12 parts, and Sn 4 parts as well as a liquid paraffin humectant are charged into in a three-dimensional mixer to mix homogeneously for 40 minutes in order to obtain metal bond; 37.41 grams of said bond used as the bond in working layer are mixed with 15.54 carats of grinded diamond having a grain size of 450/500 to mix sufficiently and homogeneously in the mixer for 30 minutes so as to obtain working layer materials; while 91.22 grams of said bond are used as non-working layer bond so as to obtain non-working layer materials.

2) Compression molding:

The working and non-working layer materials obtained by step 1) are homogeneously charged into a reserved cavity of a mould, respectively. The materials are shaved smoothly and arranged into a compressing machine to be compression molded, so as to obtain a stock of diamond grinding wheel.

3) Sintering:

The compressed stock is quickly charged into a muffle furnace heated to 580° C. The self-propagating reaction of the stock is initiated, and the stock is sintered freely in the air. Then the power supply is cut off, and the stock is sintered and densified by its own exothermic reaction without applying any external loads. Finally, the stock is cooled along with the furnace to a room temperature to obtain a metal-bonded diamond grinding wheel.

The obtained metal bonded diamond grinding wheel has a dimension as follows:

Φ80 mm×6 mm(thickness of the wheel)×20 mm(inner pore)×5 mm(annular width of the working layer)

Concentration of the diamond: 50%.

EXAMPLE 6

The steps for preparing a metal bonded diamond grinding wheel by self-propagating pressure-less sintering include:

1) Mixing raw materials:

Each metallic powders of bond weighed based on the mass ratio as Cu 74 parts, Al 10 parts, Ni 5 parts, Ti 7 parts, and Sn 4 parts as well as a liquid paraffin humectant are charged into in a three-dimensional mixer to mix homogeneously for 40 minutes in order to obtain metal bond; 34.58 grams of said bond used as the bond in working layer are mixed with 5.96 carats of grinded diamond having a grain size of 270/325 to mix sufficiently and homogeneously in the mixer for 30 minutes so as to obtain working layer materials; while 133.18 grams of said bond are used as non-working layer bond so as to obtain non-working layer materials.

2) Compression molding:

The working and non-working layer materials obtained by step 1) are homogeneously charged into a reserved cavity of a mould, respectively. The materials are shaved smoothly and arranged into a compressing machine to be compression molded, so as to obtain a stock of diamond grinding wheel.

3) Sintering:

The compressed stock is quickly charged into a muffle furnace heated to 620° C. The self-propagating reaction of the stock is initiated, and the stock is sintered freely in the air. Then the power supply is cut off, and the stock is sintered and densified by its own exothermic reaction without applying any external loads. Finally, the stock is cooled along with the furnace to a room temperature to obtain a metal-bonded diamond grinding wheel.

The obtained metal bonded diamond grinding wheel has a dimension as follows:

Φ120 mm×3 mm(thickness of the wheel)×25.4 mm(inner pore)×5 mm(annular width of the working layer)

Concentration of the diamond: 25%.

EXAMPLE 7

The steps for preparing a metal bonded diamond grinding wheel by self-propagating pressure-less sintering include:

1) Mixing raw materials:

Each metallic powders of bond weighed based on the mass ratio as Cu 58 parts, Al 6 parts, Ni 10 parts, Ti 18 parts, Sn 5 parts and Co 3 parts as well as a liquid paraffin humectant are charged into in a three-dimensional mixer to mix homogeneously for 40 minutes in order to obtain metal bond; 26.30 grams of said bond used as the bond in working layer are mixed with 9.84 carats of grinded diamond having a grain size of 500/600 to mix sufficiently and homogeneously in the mixer for 30 minutes so as to obtain working layer materials; while 94.93 grams of said bond are used as non-working layer bond so as to obtain non-working layer materials.

2) Compression molding:

The working and non-working layer materials obtained by step 1) are homogeneously charged into a reserved cavity of a mould, respectively. The materials are shaved smoothly and arranged into a compressing machine to be compression molded, so as to obtain a stock of diamond grinding wheel.

3) Sintering:

The compressed stock is quickly charged into a muffle furnace heated to 650° C. The self-propagating reaction of the stock is initiated, and the stock is sintered freely in the air. Then the power supply is cut off, and the stock is sintered and densified by its own exothermic reaction without applying any external loads. Finally, the stock is cooled along with the furnace to a room temperature to obtain a metal-bonded diamond grinding wheel.

The obtained metal bonded diamond grinding wheel has a dimension as follows:

Φ100 mm×3 mm(thickness of the wheel)×20 mm(inner pore)×5 mm(annular width of the working layer)

Concentration of the diamond: 50%.

What is claimed is:

1. A metal-bonded diamond grinding wheel prepared by self-propagating pressure-less sintering, which mainly comprises a working layer and a non-working layer, the working layer comprising metal bond and diamond grain, the non-working layer being metal bond, wherein the components of the metal bond of the working layer are the same as those of the non-working layer, characterized in that, the components of the metal bond comprise metal powders of Cu, Al, Ti, Ni, and Sn, and optionally Co powder, wherein said metal bond satisfies the requirements of self-propagating pressure-less sintering, and said metallic powders have a part of weight ratio of Cu:Al:Ti:Ni:Sn:Co=50~80:3~20:5~20:5~20:4~10:0~5.

2. The grinding wheel according to claim 1, wherein said metallic powders have a part by weight ratio of Cu:Al:Ti:Ni:Sn:Co=63~70:5~10:10~15:5~12:6~10:3~5.

3. The grinding wheel according to claim 2, wherein said diamond grain has a grain size of 70/80~600/700 and a concentration of 20%~100%.

4. The grinding wheel according to claim 2, wherein said metallic powders have an average grain size of no more than 38 microns.

5. The grinding wheel according to claim 1, wherein said metallic powders have a part by weight ratio of Cu:Al:Ti:Ni:Sn:Co=63:7:5:15:10:3.

6. The grinding wheel according to claim 5, wherein said metallic powders have an average grain size of no more than 38 microns.

7. The grinding wheel according to claim 1, wherein said diamond grain has a grain size of 70/80~600/700 and a concentration of 20%~100%.

8. The grinding wheel according to claim 7, wherein said diamond grain has a grain size of 80/100~325/400 and a concentration of 75%~100%.

9. The grinding wheel according to claim 8, wherein said diamond grain has a grain size of 80/100 and a concentration of 100%.

10. The grinding wheel according to claim 8, wherein said metallic powders have an average grain size of no more than 38 microns.

11. The grinding wheel according to claim 7, wherein said metallic powders have an average grain size of no more than 38 microns.

12. The grinding wheel according to claim 1, wherein said metallic powders have an average grain size of no more than 38 microns.

13. The grinding wheel according to claim 1, wherein said diamond grain has a grain size of 70/80~600/700 and a concentration of 20%~100%.

14. The grinding wheel according to claim 1, wherein said metallic powders have an average grain size of no more than 38 microns.

15. The grinding wheel according to claim 1, wherein said metal bond comprises Co powder.

16. A method for preparing a metal-bonded diamond grinding wheel, which comprises the following steps:

mixing raw materials;

compression molding the resultant; and sintering the resultant;

wherein said sintering is self-propagating pressure-less sintering, and wherein the grinding wheel mainly comprises a working layer and a non-working layer, the working layer comprising metal bond and diamond grain, the non-working layer being metal bond, wherein the components of the metal bond of the working layer are the same as those of the non-working layer, the components of the metal bond comprise metal powders of Cu, Al, Ti, Ni, and Sn, and optionally Co powder, wherein said metal bond satisfies the requirements of self-propagating pressure-less sintering, and said metallic powders have a part of weight ratio of Cu:Al:Ti:Ni:Sn:Co=50~80:3~20:5~20:5~20:4~10:0~5.

17. The method according to claim 16, wherein said self-propagating pressure-less sintering step comprises, after the steps of mixing and compression molding, placing the metal bonded diamond grinding wheel stock in a furnace with a temperature of 500° C. to 650° C., initiating a self-propagating reaction, then cutting off the power supply, sintering and densifying said stock by its own exothermic reaction without applying any external loads, finally cooling it along with the furnace to a room temperature to obtain a metal-bonded diamond grinding wheel.

18. The method according to claim 17, wherein said metal bond in the metal-bonded diamond grinding wheel comprises the following parts by weight of metallic powders:

Cu 63~70 parts, Al 5~10 parts, Ti 10~15 parts, Ni 5~12 parts, Sn 6~10 parts and Co 3~5 parts.

19. The method according to claim 16, wherein said metal bond in the metal-bonded diamond grinding wheel comprises the following parts by weight of metallic powders: Cu 63parts, Al 7 parts, Ni 5 parts, Ti 15 parts, Sn 10 parts and Co 3 parts.

* * * * *